US010350616B2

(12) United States Patent
Hirano

(10) Patent No.: US 10,350,616 B2
(45) Date of Patent: Jul. 16, 2019

(54) FILM FORMING METHOD AND FILM FORMING APPARATUS

(71) Applicant: NHK Spring Co., Ltd., Yokohama-shi (JP)

(72) Inventor: Satoshi Hirano, Kanagawa (JP)

(73) Assignee: NHK Spring Co., Ltd., Yokohama-shi (JP)

( * ) Notice: Subject to any disclaimer, the term of this patent is extended or adjusted under 35 U.S.C. 154(b) by 536 days.

(21) Appl. No.: 14/433,744

(22) PCT Filed: Oct. 8, 2013

(86) PCT No.: PCT/JP2013/077391
§ 371 (c)(1),
(2) Date: Apr. 6, 2015

(87) PCT Pub. No.: WO2014/057951
PCT Pub. Date: Apr. 17, 2014

(65) Prior Publication Data
US 2015/0251196 A1 Sep. 10, 2015

(30) Foreign Application Priority Data
Oct. 10, 2012 (JP) ..... 2012-225535

(51) Int. Cl.
*B05B 1/02* (2006.01)
*B05B 7/14* (2006.01)
(Continued)

(52) U.S. Cl.
CPC ..... *B05B 1/02* (2013.01); *B05B 7/1481* (2013.01); *B05D 1/12* (2013.01); *B05D 3/0486* (2013.01);
(Continued)

(58) Field of Classification Search
None
See application file for complete search history.

(56) References Cited

U.S. PATENT DOCUMENTS 3,745,034 A * 7/1973 Smith et al. ..... B05B 5/14 118/308
4,411,935 A * 10/1983 Anderson ..... B05B 7/205 118/308
(Continued)

FOREIGN PATENT DOCUMENTS

EP 2175050 A1 4/2010
JP 05-171399 A 7/1993
(Continued)

OTHER PUBLICATIONS

International Search Report dated Dec. 10, 2013, issued for PCT/JP2013/077391.
(Continued)

*Primary Examiner* — Jethro M. Pence
(74) *Attorney, Agent, or Firm* — Locke Lord LLP

(57) ABSTRACT

A film forming method of forming a film by accelerating powder of a material with gas and spraying and depositing the powder onto a surface of a substrate with the powder being kept in a solid state includes: a substrate film forming step of forming a film. The film forming step includes jetting out the powder and inert gas from a nozzle towards the substrate, causing inside of the chamber to be under positive pressure by the inert gas, and depositing the powder on the surface of the substrate.

6 Claims, 3 Drawing Sheets

(51) Int. Cl.

| | |
|---|---|
| ***B05D 1/12*** | (2006.01) |
| ***C23C 24/04*** | (2006.01) |
| ***B05D 3/04*** | (2006.01) |

(52) U.S. Cl.

CPC ..... *C23C 24/04* (2013.01); *B05B 7/1422* (2013.01); *B05D 3/0466* (2013.01)

(56) References Cited

U.S. PATENT DOCUMENTS

| | | | | |
|---|---|---|---|---|
| 5,389,407 | A * | 2/1995 | Sokol | C23C 4/137 427/249.18 |
| 2006/0040048 | A1 | 2/2006 | Han et al. | |
| 2009/0298251 | A1 | 12/2009 | Choi et al. | |
| 2013/0263771 | A1 | 10/2013 | Kobayashi et al. | |

FOREIGN PATENT DOCUMENTS

| | | | |
|---|---|---|---|
| JP | 08-108267 | A | 4/1996 |
| JP | 2008-302311 | A | 12/2008 |
| JP | 2009-185374 | A | 8/2009 |
| JP | 2009-238641 | A | 10/2009 |
| WO | WO-2012/060309 | A1 | 5/2012 |
| WO | WO-2012/124047 | A1 | 9/2012 |

OTHER PUBLICATIONS

Notice of Rejection dated Feb. 9, 2016, issued for the Japanese patent application No. 2012-225535 and English translation thereof.
Supplementary European Search Report dated May 9, 2016, issued for the European patent application No. 13845899.7.

* cited by examiner

FILM FORMING METHOD AND FILM FORMING APPARATUS

FIELD

The present invention relates to a film forming method and a film forming apparatus, for forming a film by accelerating powder of a material, together with gas, spraying and depositing the powder onto a surface of a substrate with the powder being kept in a solid state.

BACKGROUND

In recent years, a film forming method called, "cold spray method", has been known. A cold spray method is a method of: jetting out powder of a metallic material in a state where the metallic material is at its melting point or softening point or lower, together with inert gas, such as helium, argon, or nitrogen, from a nozzle; causing the powder kept in its solid state to collide with a substrate to be subjected to film formation; and forming a film on a surface of the substrate (for example, see Patent Literature 1). In the cold spray method, differently from a thermal spraying method (for example, see Patent Literature 2) of melting powder of a material and spraying the powder onto a substrate, film formation is performed at comparatively low temperature. Therefore, by the cold spray method, an influence of thermal stress is able to be alleviated and a metallic film with no phase transformation and suppressed oxidation is able to be obtained. In particular, if the material to be the substrate and film is metallic, when the powder of the metallic material collides with the substrate (or the film that has been formed first), since plastic deformation occurs between the powder and substrate to provide anchor effect, the oxide films are mutually destroyed, and metallic bonding is generated between the newly formed surfaces, a layered body having high adhesive strength is able to be obtained.

CITATION LIST

Patent Literature

Patent Literature 1: Japanese Laid-open Patent Publication No. 2008-302311

Patent Literature 2: Japanese Laid-open Patent Publication No. 05-171399

SUMMARY

Technical Problem

Normally, the cold spray method is conducted in the atmosphere. Further, in the cold spray method, since the powder is accelerated to high speed by compressed gas, a nozzle having a hole diameter small as compared with the substrate is used. Therefore, a film that has been already formed on an area, which is other than an area where the powder jetted out from the nozzle is being sprayed on for film formation, is exposed to oxygen in the atmosphere and may be oxidized. As a result, film formation is further conducted over the oxidized film and bonding between the top layer and the bottom layer becomes insufficient, influencing bonding strength and film properties, such as electric properties.

In order to suppress the exposure of the film to oxygen, film formation within a decompressed chamber may be considered. However, in that case, an exhaust device is required to be provided in the chamber and thus the configuration of the apparatus becomes complicated and cost of the apparatus becomes expensive. Further, a long period of time is required to achieve the decompressed atmosphere after the substrate is arranged in the chamber, and thus start of film formation is delayed. Furthermore, in order to replace the substrate, a sequence of releasing the decompressed atmosphere, replacing the substrate, decompressing again, and the like, becomes necessary, and this sequence problematically requires time and effort.

As another means for suppressing the exposure of the film to oxygen, film formation without oxygen by filling the inert gas into the chamber may be considered. However, in this case also, a device for supplying the inert gas needs to be separately provided in the chamber, increasing the cost of the apparatus. Further, time for replacing the atmosphere in the chamber with the inert gas after arranging the substrate in the chamber is required, and thus time and effort are again required to replace the substrate.

The present invention has been made in view of the above, and an object thereof is to provide a film forming method and a film forming apparatus, which are able to achieve: suppression of oxidation of a film being formed; a simple and inexpensive apparatus configuration; and replacement of a substrate to be subjected to film formation without time and trouble.

Solution to Problem

To solve the above-described problem and achieve the object, a film forming method according to the present invention forms a film by accelerating powder of a material with gas and spraying and depositing the powder onto a surface of a substrate with the powder being kept in a solid state, and the film forming method includes: a substrate arrangement step of arranging the substrate in a chamber; and a film forming step of forming a film. The film forming step includes: jetting out the powder and inert gas from a nozzle towards the substrate; causing inside of the chamber to be under positive pressure by the inert gas; and depositing the powder on the surface of the substrate.

In the above-described film forming method, the film forming step is performed while the inert gas is exhausted from the chamber.

In the above-described film forming method, the film forming step is performed while flow of the inert gas in the chamber is regulated.

In the above-described film forming method, the flow of the inert gas is regulated by supplying inert gas into the chamber, separately from the nozzle.

A film forming apparatus according to the present invention forms a film by accelerating powder of a material with gas and spraying and depositing the powder onto a surface of a substrate with the powder being kept in a solid state, and includes: a chamber; a holding unit that is provided in the chamber and configured to hold the substrate; a nozzle configured to jet out the powder with inert gas; and a moving mechanism configured to move any one of the nozzle and the holding unit with respect to other one of the nozzle and the holding unit, wherein inside of the chamber is caused to be under positive pressure by the inert gas jetted out from the nozzle.

The above-described film forming apparatus further includes an exhaust unit configured to exhaust gas from the chamber.

The above-described film forming apparatus further includes a flow regulating mechanism configured to regulate flow of the inert gas inside the chamber.

In the above-described film forming apparatus, the flow regulating mechanism is a gas supplying unit configured to supply the inert gas into the chamber.

In the above-described film forming apparatus, the flow regulating mechanism is a flow regulating member arranged in the chamber.

In the above-described film forming apparatus, the chamber comprises: a container including the holding unit provided in the chamber; and a lid portion attached to the nozzle.

In the above-described film forming apparatus, the chamber comprises a cover that is attached to the nozzle and configured to cover the holding unit.

Advantageous Effects of Invention

According to the present invention, since powder of a material and inert gas are jetted out towards a substrate, inside of a chamber is caused to be under positive pressure by the inert gas, and the powder is deposited on a surface of the substrate; the substrate is prevented from being exposed to oxygen and oxidation of a film being formed is able to be suppressed. Further, according to the present invention, since an additional device, such as an exhaust device or an inert gas supplying device, is not required to be provided in the chamber, the apparatus is able to be configured simply and inexpensively. Furthermore, according to the present invention, since an additional operation, such as decompressing the chamber or replacing the gas, is not required before film formation, the substrate is able to be replaced without time and effort.

DESCRIPTION OF EMBODIMENTS

Hereinafter, modes for carrying out the present invention will be described in detail, with reference to the drawings. The present invention is not limited by the following embodiments. Further, each drawing referred to in the following description just schematically illustrates shapes, sizes, and positional relations so as to allow contents of the present invention to be understood. That is, the present invention is not limited only to the shapes, sizes, and positional relations exemplified in each drawing.

First Embodiment

Figure 1:
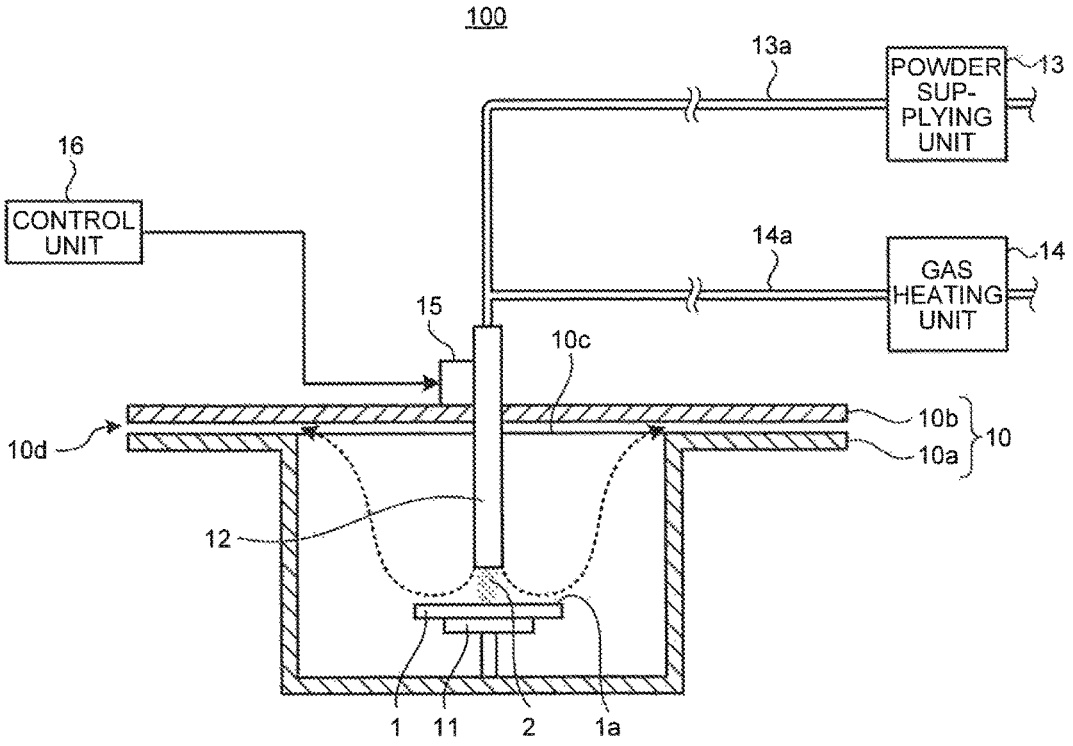
FIG. 1 is a schematic diagram illustrating a film forming apparatus according to a first embodiment of the present invention.

FIG. 1 is a schematic diagram illustrating a configuration of a film forming apparatus according to a first embodiment of the present invention. As illustrated in FIG. 1, a film forming apparatus 100 according to the first embodiment is a so-called cold spray apparatus, which forms a film by spraying and depositing powder 2 of a material onto a surface of a substrate 1, and the film forming apparatus 100 includes: a chamber 10; a holding unit 11 that holds the substrate 1; a spray nozzle 12 that jets out the powder 2 together with inert gas; a powder supplying unit 13 and a powder piping 13*a*, which supply the powder 2 to the spray nozzle 12; a gas heating unit (gas supplying unit) 14 and a gas piping 14*a*, which heat up the inert gas and supply the heated inert gas to the spray nozzle 12; a drive unit 15 that moves the spray nozzle 12; and a control unit 16 that controls operations of the drive unit 15. In FIG. 1, a cross section of only the chamber 10 is illustrated.

The chamber 10 has: a container 10*a* that is formed in a bottomed column shape; and a lid portion 10*b* that covers an opening of the container 10*a*. The specific shape of the container 10*a* is not particularly limited, and in the first embodiment, is a shape, in which a flange extending outwards from the opening is provided in the bottomed column. Further, a shape of the lid portion 10*b* is prescribed according to a shape of the opening of the container 10*a*, and in the first embodiment, is a disc shape.

The lid portion 10*b* is attached to the spray nozzle 12 by fastening, bonding, welding, or the like, and is supported by a non-illustrated support mechanism of the spray nozzle 12 to be three dimensionally movable. Further, as illustrated in FIG. 1, when a film is formed on the substrate 1, in a state where the lid portion 10*b* is floating slightly (so that at least gas is able to pass through) from an opening plane 10*c* of the container 10*a*, the lid portion 10*b* is movably supported (in a horizontal direction in FIG. 1) in a plane parallel to the opening plane 10*c*. A gap 10*d* then between the container 10*a* and the lid portion 10*b* functions as an exhaust port for exhausting the gas inside the chamber 10 to outside.

A diameter of the lid portion 10*b* is designed to be larger than a diameter of the opening of the container 10*a*, according to a movable range of the spray nozzle 12, such that the opening of the container 10*a* is not exposed even if the lid portion 10*b* is moved in the plane parallel to the opening plane 10*c* upon film formation.

The holding unit 11 is provided, for example, at a bottom portion of the container 10*a*. The holding unit 11 includes a holding mechanism, such as an electrostatic chuck, and holds the substrate 1 in a state where a film forming surface 1*a* of the substrate 1 faces the spray nozzle 12. Although FIG. 1 illustrates the substrate 1, which is plate shaped and has the film forming surface 1*a* that is planar, the overall shape of the substrate 1 and the shape of the film forming surface 1*a* are not particularly limited, and they may just have a surface on which a film is able to be formed.

The spray nozzle 12 accelerates the powder 2 supplied from the powder supplying unit 13, by the inert gas supplied via the gas heating unit 14, and jets out the powder 2 at supersonic speed of, for example, 340 m/s or higher.

Compressed gas formed of inert gas, such as helium, argon, or nitrogen, which has been compressed, is supplied from the outside to the powder supplying unit 13 and gas heating unit 14. A non-illustrated valve for adjusting a feed rate of the compressed gas is provided in each of the powder supplying unit 13 and gas heating unit 14.

The powder 2 of a metal or an alloy, which is the material of the film, is contained in the powder supplying unit 13. The powder supplying unit 13 supplies the powder 2, together with the inert gas supplied from the outside, to the spray nozzle 12, via the powder piping 13*a*.

The gas heating unit 14 heats up the inert gas supplied from the outside to a predetermined temperature and supplies the heated inert gas to the spray nozzle 12 via the gas piping 14*a*. The temperature to which the inert gas is heated up is, for example, equal to or higher than 50° C., and according to a type of the powder 2, is set (for example, to about 300° C. to 900° C.) such that the powder 2 does not melt.

The drive unit 15 is provided at the spray nozzle 12, and is a part of a moving mechanism that moves the spray nozzle 12 together with the lid portion 10*b*. A well known general technique is applicable as the moving mechanism and in FIG. 1, illustration of the entire moving mechanism is omitted. By operating this drive unit 15 to move the spray nozzle 12 in the plane parallel to the opening plane 10*c* of the container 10*a*, the film forming surface 1*a* of the substrate 1 is scanned by the powder 2 jetted out from the spray nozzle 12. The control unit 16 controls such an operation of the drive unit 15. Broken lined arrows starting from a tip of the spray nozzle 12 schematically illustrate flows of the inert gas.

Figure 2:
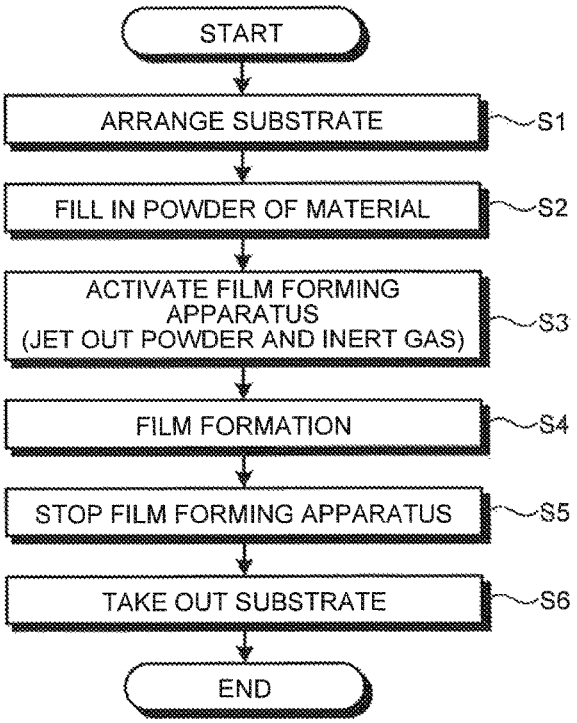
FIG. 2 is a flow chart illustrating a film forming method according to the first embodiment of the present invention.

Next, a film forming method according to the first embodiment will be described. FIG. 2 is a flow chart illustrating the film forming method according to the first embodiment.

First, in Step S1, the substrate is arranged in the chamber 10. A material to be used as the substrate 1 is not particularly limited, and may be: a metal or an alloy, such as copper, copper alloy, zinc, zinc alloy, aluminum, aluminum alloy, magnesium, magnesium alloy, nickel, nickel alloy, iron, iron alloy, titanium, titanium alloy, chromium, chromium alloy, niobium, niobium alloy, molybdenum, molybdenum alloy, silver, silver alloy, tin, tin alloy, tantalum, tantalum alloy, or the like; or a ceramic, such as alumina, zirconia, yttria, yttria stabilized zirconia, or the like. A surface treatment may be performed as appropriate in advance on the substrate 1 formed of any of these materials. In the chamber 10, the substrate 1 is fixed by being held by the holding unit 11.

At subsequent Step S2, the powder 2, which is a material of a film to be formed on the substrate 1, is filled into the powder supplying unit 13. A type of the powder 2 is not particularly limited, and according to use of the film, a metal or an alloy, such as copper, copper alloy, zinc, zinc alloy, aluminum, aluminum alloy, magnesium, magnesium alloy, nickel, nickel alloy, iron, iron alloy, titanium, titanium alloy, chromium, chromium alloy, niobium, niobium alloy, molybdenum, molybdenum alloy, silver, silver alloy, tin, tin alloy, tantalum, tantalum alloy, or the like may be selected as appropriate. Further, a mean particle diameter of the powder 2 is not particularly limited as long as the mean particle diameter is of a size (for example, about 5 μm to 100 μm) that enables cold spraying.

At subsequent Step S3, the film forming apparatus 100 is activated. Thereby, supply of the compressed gas (inert gas) to the powder supplying unit 13 and gas heating unit 14 is started and the powder 2 and heated inert gas are supplied to the spray nozzle 12. In the spray nozzle 12, the powder 2 is charged into the supersonic flow of the compressed inert gas and accelerated, and jetted out with its solid state being kept, together with the inert gas, from the spray nozzle 12.

Thereby, the atmosphere is exhausted from the gap 10*d* by the inert gas jetted out from the spray nozzle 12 and the inside of the chamber 10 is caused to be under positive pressure. Therefore, the inert gas jetted out from the spray nozzle 12 collides with the surface of the substrate 1, thereafter circulates inside the chamber 10, and is exhausted to the outside of the chamber 10 from the gap 10*d*, as illustrated with the broken lines in FIG. 1. When this happens, since the inside of the chamber 10 is under positive pressure, the outside atmosphere is prevented from entering the chamber 10.

Pressure of the inert gas supplied to the spray nozzle 12 is preferably 1 MPa to 5 MPa. This is because, by adjusting the pressure like this, the inside of the chamber 10 is able to be made under positive pressure by the inert gas at an early stage, and in later Step S4, improvement of adhesive strength between the substrate 1 and the film formed thereon is able to be achieved.

At Step S4, a film is formed on the substrate 1. That is, while the powder 2 is being jetted out from the spray nozzle 12 to be sprayed onto the film forming surface 1*a*, the spray nozzle 12 is moved in the horizontal direction to deposit the powder 2 onto the film forming surface 1*a*. When that is done, since the inside of the chamber 10 is filled with the inert gas jetted out from the spray nozzle 12, the film on the film forming surface 1*a* is prevented from being exposed to oxygen and oxidation of the film is able to be suppressed.

After a film of a desired thickness is formed on the film forming surface 1*a*, the film forming apparatus 100 is stopped (Step S5). Thereafter, at Step S6, the lid portion 10*b* is removed from the container 10*a*, and the substrate 1 is taken out. Thereby, a film formed by the cold spray method is obtained. Thereafter, another substrate may be held by the holding unit 11 of the film forming apparatus 100 and film formation may be performed continuously.

As described above, according to the first embodiment, since the inside of the chamber 10 is filled with the inert gas jetted out from the spray nozzle 12 to be under positive pressure and film formation is performed, oxidation of the formed film by the formed film being exposed to oxygen in the atmosphere is able to be suppressed. Therefore, physical properties in the film, such as the bonding strength and electric properties, are able to be improved.

Further, according to the first embodiment, since an additional device (such as an exhaust device or gas supplying device) for removing the atmosphere from the inside of the chamber 10 is not required to be provided, a configuration of the apparatus is able to be simplified and increase in cost of the apparatus is able to be suppressed.

Furthermore, according to the first embodiment, since the inside of the chamber 10 is caused to be under positive pressure by the inert gas jetted out from the spray nozzle 12, an additional operation (exhaust, gas replacement, or the like) for removing the atmosphere from the chamber 10 and waiting time, after arrangement of the substrate 1 in the chamber 10, become unnecessary. Therefore, replacement of the substrate 1 becomes easy and film formation is able to be conducted efficiently.

First Modified Example

Next, a first modified example of the first embodiment will be described.

Figure 3:
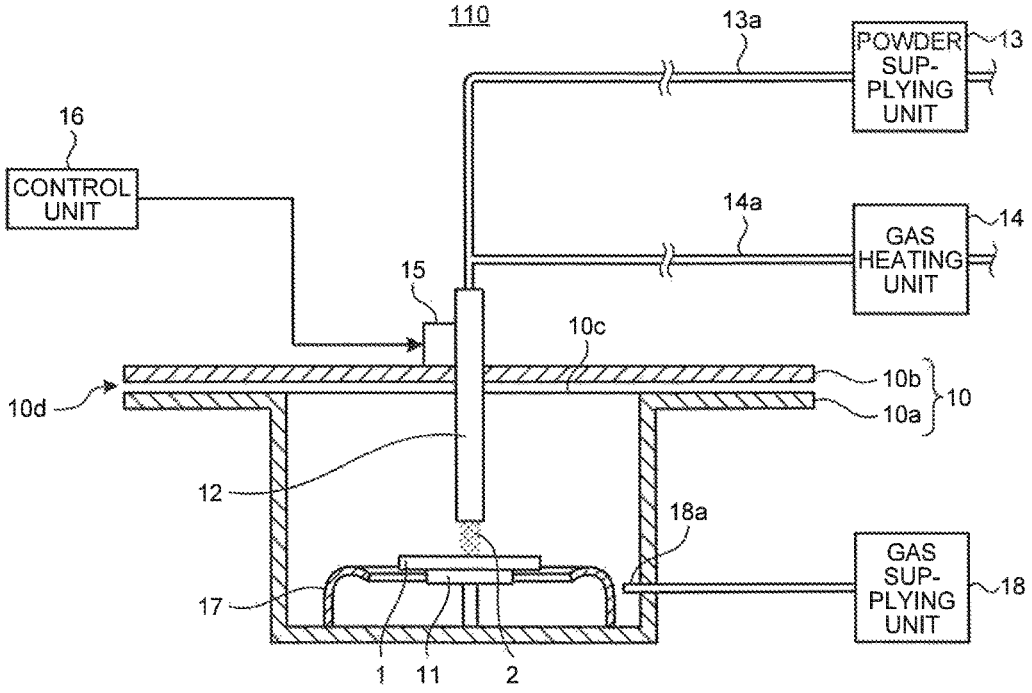
FIG. 3 is a schematic diagram illustrating a first modified example of the film forming apparatus according to the first embodiment of the present invention.

FIG. 3 is a schematic diagram illustrating a film forming apparatus according to a first modified example of the first embodiment. A film forming apparatus 110 illustrated in FIG. 3 further includes, in contrast to the film forming apparatus 100, a flow regulating unit 17 and a gas supplying unit 18 for regulating flow of inert gas inside the chamber 10.

The flow regulating unit 17 is formed by bending one end of a cylindrical member inwards and is provided near the bottom portion of the container 10*a* to surround the holding unit 11. The flow regulating unit 17 regulates the flow of the inert gas jetted out from the spray nozzle 12 so that the flow circulates inside the chamber 10 to be exhausted out from the gap 10*d*.

The gas supplying unit 18 includes a gas jetting port 18*a* provided near the bottom portion of the container 10*a* and forms flow of the inert gas circulating inside the chamber 10 by supplying the inert gas into the chamber 10. By flowing the inert gas along an inner wall surface from near the bottom portion of the container 10*a*, the inert gas is able to be efficiently circulated inside the chamber 10.

By providing the flow regulating unit 17 and gas supplying unit 18, exhaust of the atmosphere remaining in the chamber 10 is able to be achieved earlier and the inside of the chamber 10 is able to be filled with the inert gas jetted out from the spray nozzle 12 promptly. Therefore, oxidation of the film formed on the substrate 1 is able to be suppressed even more effectively.

Figure 4:
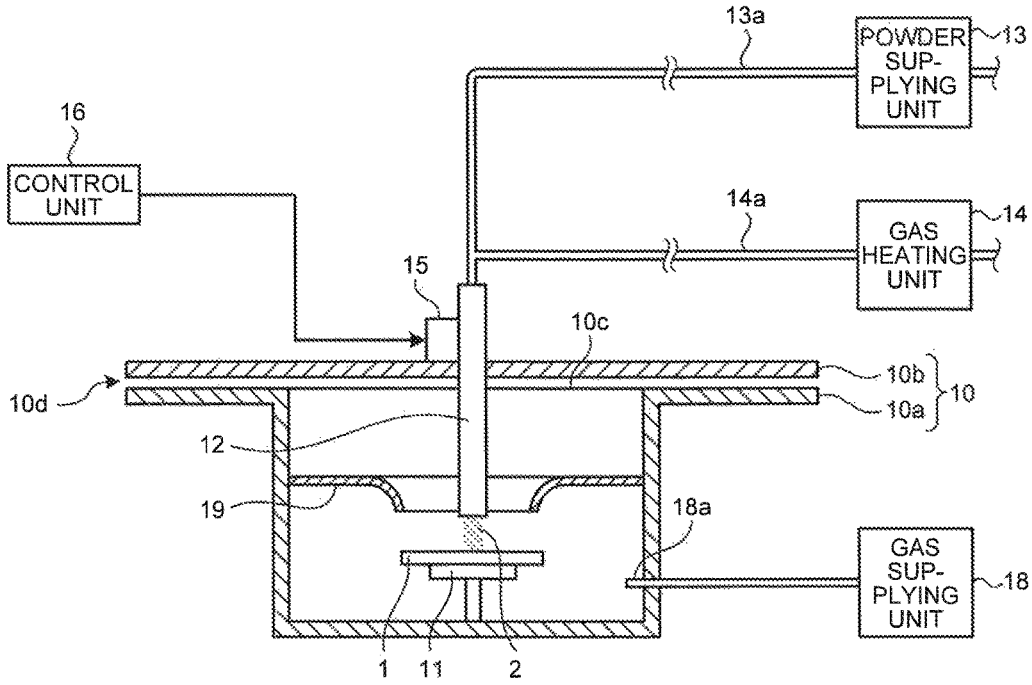
FIG. 4 is a schematic diagram illustrating another example of a flow regulating unit provided in a chamber.

In the film forming apparatus 110, only one of the flow regulating unit 17 and the gas supplying unit 18 may be provided. Further, a shape and arrangement of the flow regulating unit 17 are not limited to the example illustrated in FIG. 3, as long as the above described flow of the inert gas is able to be formed. As another example of the flow regulating unit, as illustrated in FIG. 4, a flow regulating unit 19, which is formed with an opening by a central portion of a plate shaped member being bent and which is doughnut shaped, may be provided like a brim, at a height in the middle of an inner wall side surface of the container 10*a*. A position and a direction of the gas jetting port 18*a* is also not limited to the example illustrated in FIG. 3, as long as the above described flow of the inert gas is able to be formed.

Second Modified Example

Next, a second modified example of the first embodiment will be described.

Although the gap 10*d* provided between the container 10*a* and the lid portion 10*b* serves as the exhaust port in the above described first embodiment, a form of the exhaust port is no limited to the example illustrated in FIG. 1. For example, an opening may be provided in the lid portion 10*b* to serve as the exhaust port. Or, an opening may be provided on an upper portion of a side surface of the container 10*a* to serve as the exhaust port. In these cases, the lid portion 10*b* is able to be directly placed on the opening plane 10*c* of the container 10*a*.

Second Embodiment

Next, a second embodiment of the present invention will be described.

Figure 5:
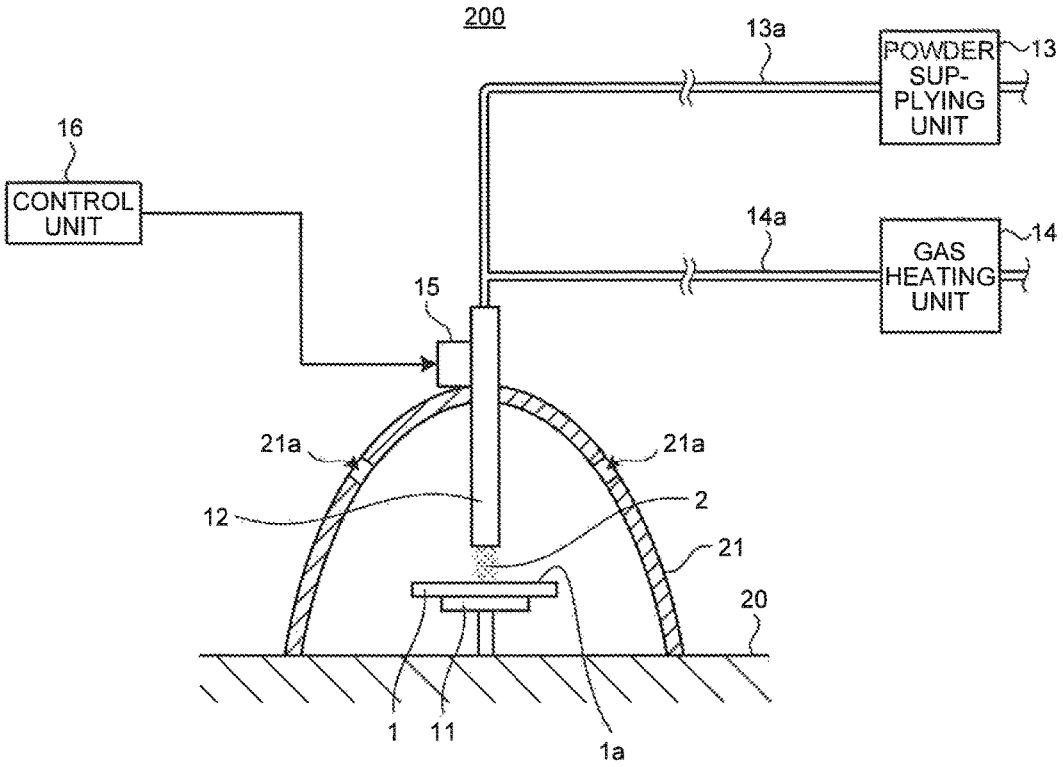
FIG. 5 is a schematic diagram illustrating a film forming apparatus according to a second embodiment of the present invention.

FIG. 5 is a schematic diagram illustrating a film forming apparatus according to a second embodiment of the present invention. As illustrated in FIG. 5, a film forming apparatus 200 according to the second embodiment includes, instead of the chamber 10 illustrated in FIG. 1, a cover unit 21, which is attached to the spray nozzle 12 and provided on a base 20.

Functions and operations of the holding unit 11, the spray nozzle 12, the powder supplying unit 13 and powder piping 13*a*, the gas heating unit 14 and gas piping 14*a*, the drive unit 15, and the control unit 16, which are illustrated in FIG. 5, are the same as those of the first embodiment. Further, in FIG. 5, cross sections of only the base 20 and cover unit 21 are illustrated. Furthermore, in FIG. 5, illustration of, the support mechanism, and the moving mechanism as a whole, of the spray nozzle 12, is omitted, and from the moving mechanism, only the drive unit 15 provided at the spray nozzle 12 is illustrated.

In the second embodiment, the holding unit 11 is directly provided on the base 20 and the cover unit 21 is arranged to cover the holding unit 11. The cover unit 21 may be formed of a hard member (a member difficult to be deformed), such as a metal, a ceramic, a glass, or an acrylic, or may be formed of a flexible member (a member easy to be deformed), such as rubber, or polyethylene. Or, the cover unit 21 may be formed of a combination of the hard member and the soft member. For example, the cover unit 21 may be formed by forming a framework with a hard member such as a metal, and covering the framework with a flexible member such as polyethylene sheet.

At an upper portion (at a position higher than the substrate 1 being held by the holding unit 11) of the cover unit 21, one opening 21*a* or a plurality of openings 21*a* (two in FIG. 5) is or are provided. The opening 21*a* functions as an exhaust port for exhausting gas inside the cover unit 21 to outside. The cover unit 21 is attached to the spray nozzle 12 by fastening, bonding, welding, or the like, according to the material of the cover unit 21, and moves together with the spray nozzle 12.

When a film is formed by the film forming apparatus 200, the substrate 1 is held by the holding unit 11 and the powder 2 of the material and inert gas are jetted out from the spray nozzle 12. Thereby, inside of the cover unit 21 is filled with the inert gas and is caused to be under positive pressure. By moving the spray nozzle 12 together with the cover unit 21 in a plane parallel to the base 20 while spraying the powder 2 towards the film forming surface 1*a* of the substrate 1, the powder 2 is deposited on the film forming surface 1*a*. As a result, without exposing the film formed on the film forming surface 1*a* to oxygen, film formation is able to be performed.

As described above, according to the second embodiment, since the chamber is formed of the cover unit 21 attached to the spray nozzle 12, a configuration of the film forming apparatus 200 is able to be simplified. For example, the film forming apparatus 200 is able to be realized by adding the cover unit 21 to a cold spray apparatus having a general configuration.

The flow regulating unit 17 and gas supplying unit 18 may be provided further in the film forming apparatus 200, similarly to the first embodiment.

In the above described first and second embodiments, although the substrate 1 is fixed and the spray nozzle 12 is moved, as long as one of them is able to be moved with respect to the other, any of the substrate 1 and spray nozzle 12 may be moved. For example, the spray nozzle 12 may be fixed and the substrate 1 may be moved, or both of them may be moved.

Working Example

Hereinafter, a working example of the present invention will be described.

As a working example, a pure copper film was formed on the substrate 1 by using the film forming apparatus 100 according to the first embodiment. When this was done, pressure of inert gas in the spray nozzle 12 was changed to form films of a plurality of types. By cutting out these films to make test pieces of 2 mm×2 mm×40 mm, conductivity thereof was measured by four-terminal method. In contrast, as a comparative example, a pure copper film was formed in the atmosphere by using a general cold spray apparatus. Similarly to the working example, test pieces were made to measure the conductivity.

Figure 6:
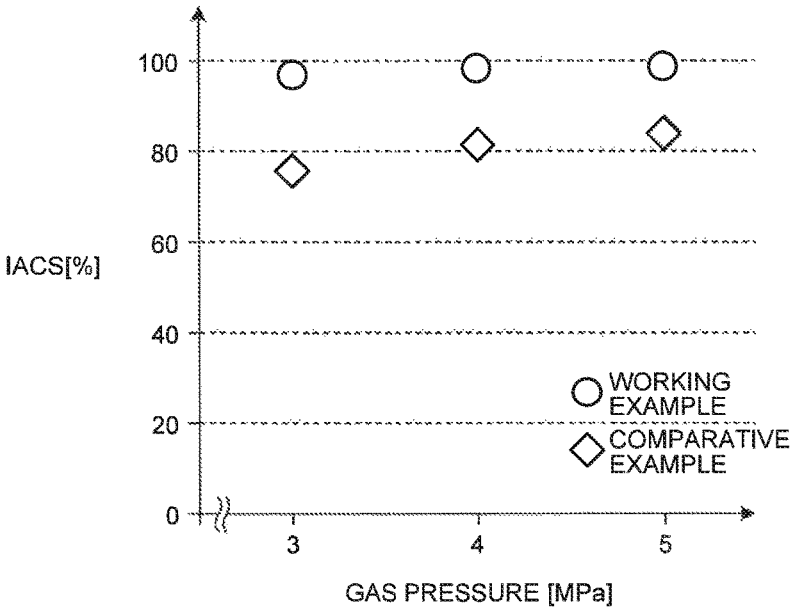
FIG. 6 is a graph illustrating properties of test pieces according to a working example and a comparative example.

FIG. 6 is a graph illustrating measurement results of the test pieces of the working example and comparative example. In FIG. 6, the horizontal axis represents pressure (gas pressure: MPa) of the inert gas and the vertical axis represents conductivity (International Annealed Copper Standard (IACS): %) of the respective test pieces with reference to conductivity of annealed pure copper.

As illustrated in FIG. 6, for the working example, regardless of the magnitude of the gas pressure, conductivity close to 100% was obtained. In contrast, for the comparative example, the higher the gas pressure was made, the higher the conductivity tended to become, but in any case, the conductivity was not as high as that of the working example.

REFERENCE SIGNS LIST

1 Substrate
1*a* Film forming surface
2 Powder
10 Chamber
10*a* Container
10*b* Lid portion
10*c* Opening plane
10*d* Gap
11 Holding unit
12 Spray nozzle
13 Powder supplying unit
13*a* Powder piping
14 Gas heating unit (gas supplying unit)
14*a* Gas piping
15 Drive unit
16 Control unit
17, 19 Flow regulating unit
18 Gas supplying unit
18*a* Gas jetting port
20 Base
21 Cover unit
21*a* Opening
100, 110, 200 Film forming apparatus

The invention claimed is:

1. A film forming apparatus forming a film by accelerating powder of a material with gas and spraying and depositing the powder onto a surface of a substrate with the powder being kept in a solid state, the film forming apparatus comprising:

a chamber;

a holding unit that is provided in the chamber and configured to hold the substrate;

a nozzle configured to jet out the powder with inert gas;

a moving mechanism configured to move any one of the nozzle and the holding unit with respect to other one of the nozzle and the holding unit; and a first flow regulating unit formed by bending one end of a cylindrical member inwards and provided near a bottom portion of the container to surround the holding unit, or a second flow regulating unit formed with an opening by a central portion of a plate shaped member being bent and is doughnut shaped, the second flow regulating unit being provided like a brim at a height in the middle of an inner wall side surface of the container, wherein the chamber comprises a container enclosing therein the holding unit provided in the chamber and a lid portion attached to the nozzle and configured to cover an opening of the container, and inside of the chamber is caused to be under positive pressure by the inert gas jetted out from the nozzle.

2. The film forming apparatus according to claim 1, further comprising an exhaust unit configured to exhaust gas from the chamber.

3. The film forming apparatus according to claim 1, further comprising a flow regulating mechanism configured to regulate flow of the inert gas inside the chamber.

4. The film forming apparatus according to claim 3, wherein the flow regulating mechanism is a gas supplying unit configured to supply the inert gas into the chamber.

5. The film forming apparatus according to claim 3, wherein the flow regulating mechanism is a flow regulating member arranged in the chamber.

6. A film forming apparatus forming a film by accelerating powder of a material with gas and spraying and depositing the powder onto a surface of a substrate with the powder being kept in a solid state, the film forming apparatus comprising:

a chamber;

a holding unit that is provided in the chamber and configured to hold the substrate;

a nozzle configured to jet out the powder with inert gas;

a moving mechanism configured to move any one of the nozzle and the holding unit with respect to other one of the nozzle and the holding unit; and a first flow regulating unit formed by bending one end of a cylindrical member inwards and provided near a bottom portion of the container to surround the holding unit, or a second flow regulating unit formed with an opening by a central portion of a plate shaped member being bent and is doughnut shaped, the second flow regulating unit being provided like a brim at a height in the middle of an inner wall side surface of the container, wherein the chamber comprises a cover that is attached to the nozzle and configured to enclose therein the holding unit, and inside of the chamber is caused to be under positive pressure by the inert gas jetted out from the nozzle.

* * * * *